US005152023A

United States Patent [19]

Graebe

[11] Patent Number: 5,152,023

[45] Date of Patent: Oct. 6, 1992

[54] CELLULAR CUSHION HAVING SEALED CELLS

[76] Inventor: Robert W. Graebe, 210 Bluff Dr., Belleville, Ill. 62223

[21] Appl. No.: 612,804

[22] Filed: Nov. 13, 1990

[51] Int. Cl.[5] ..... A47C 27/08

[52] U.S. Cl. ..... 5/455; 5/457; 5/654

[58] Field of Search ..... 5/441, 449, 455–458, 5/653, 654

[56] References Cited

U.S. PATENT DOCUMENTS

| | | | |
|---|---|---|---|
| 2,495,124 | 1/1950 | Morner | 5/455 |
| 3,018,015 | 1/1962 | Agriss et al. . | |
| 3,231,454 | 1/1966 | Williams . | |
| 3,294,387 | 12/1966 | Chavannes . | |
| 3,294,389 | 12/1966 | Chavannes . | |
| 3,468,311 | 9/1969 | Gallagher | 5/455 X |
| 3,850,167 | 11/1974 | Seeley . | |
| 3,870,450 | 3/1975 | Graebe . | |
| 3,982,786 | 9/1976 | Burgin et al. | 5/455 |
| 4,314,865 | 2/1982 | Ottaviano . | |
| 4,541,136 | 9/1985 | Graebe . | |
| 4,698,864 | 10/1987 | Graebe | 5/455 X |
| 4,730,610 | 3/1988 | Graebe . | |
| 4,860,397 | 8/1989 | Gusakov | 5/455 |

*Primary Examiner*—Michael F. Trettel

*Attorney, Agent, or Firm*—Polster, Lieder, Woodruff & Lucchesi

[57] ABSTRACT

A cellular cushion has a flexible base and flexible cells projecting outwardly from the base. The cells, which are formed from an elastomeric material and contain a gas such as air, are organized into longitudinal and transverse rows, and webs within the base separate the cells of adjacent rows. At least some of the cells are sealed in the sense that their interiors are totally isolated from all other cells and from the surrounding atmosphere. The cushion may also contain a zone of cells which are interconnected in the sense that their interiors are in communication along the webs of the base.

10 Claims, 3 Drawing Sheets

FIG. 1.
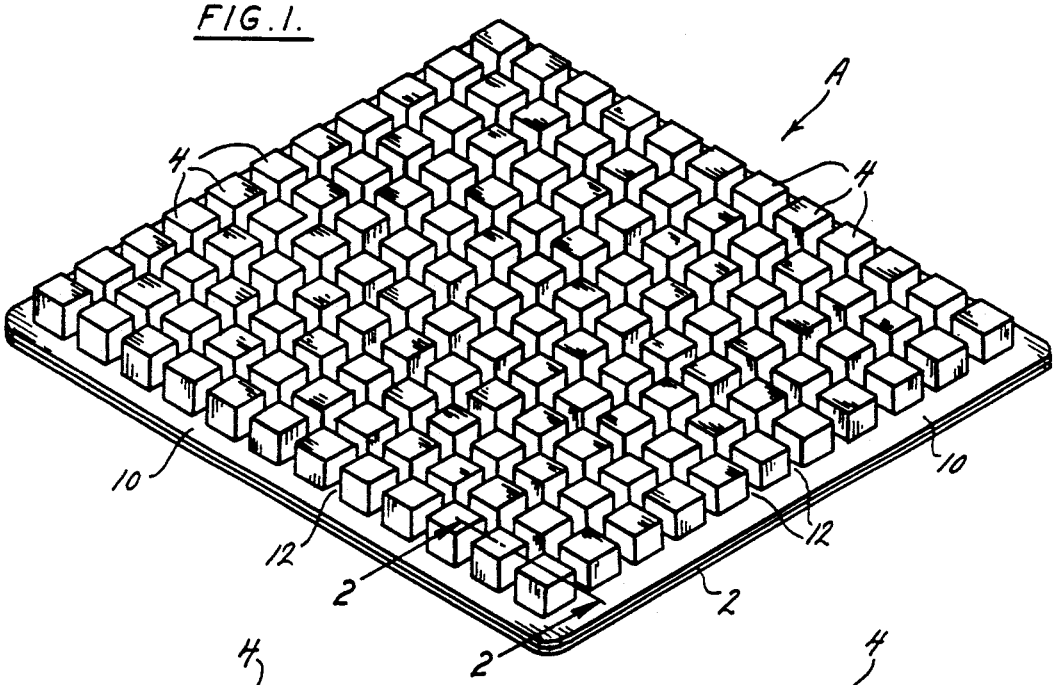
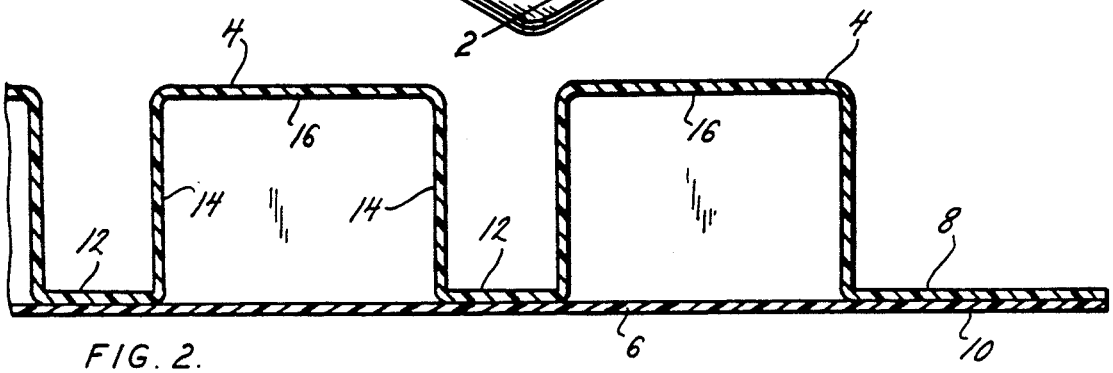
FIG. 2.
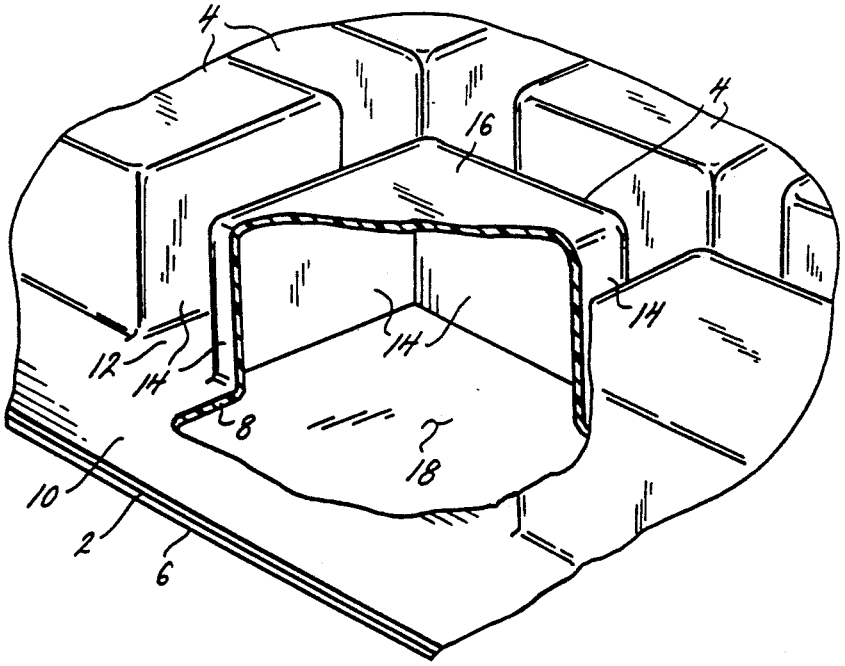
FIG. 3.

FIG. 4.
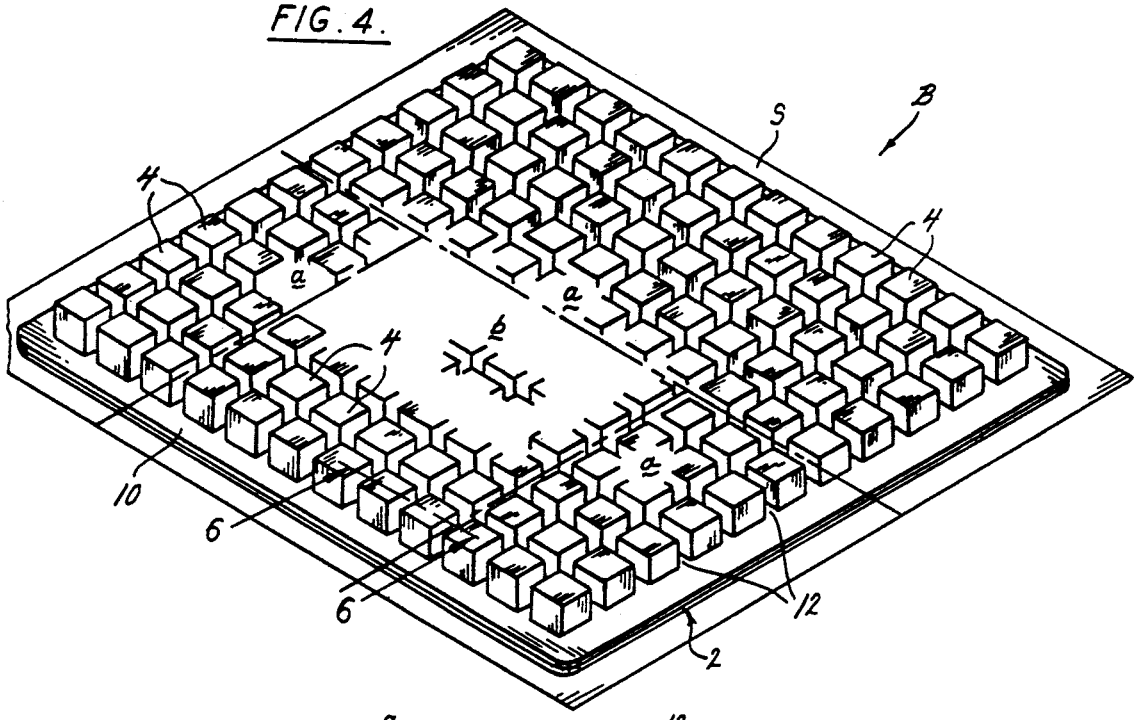
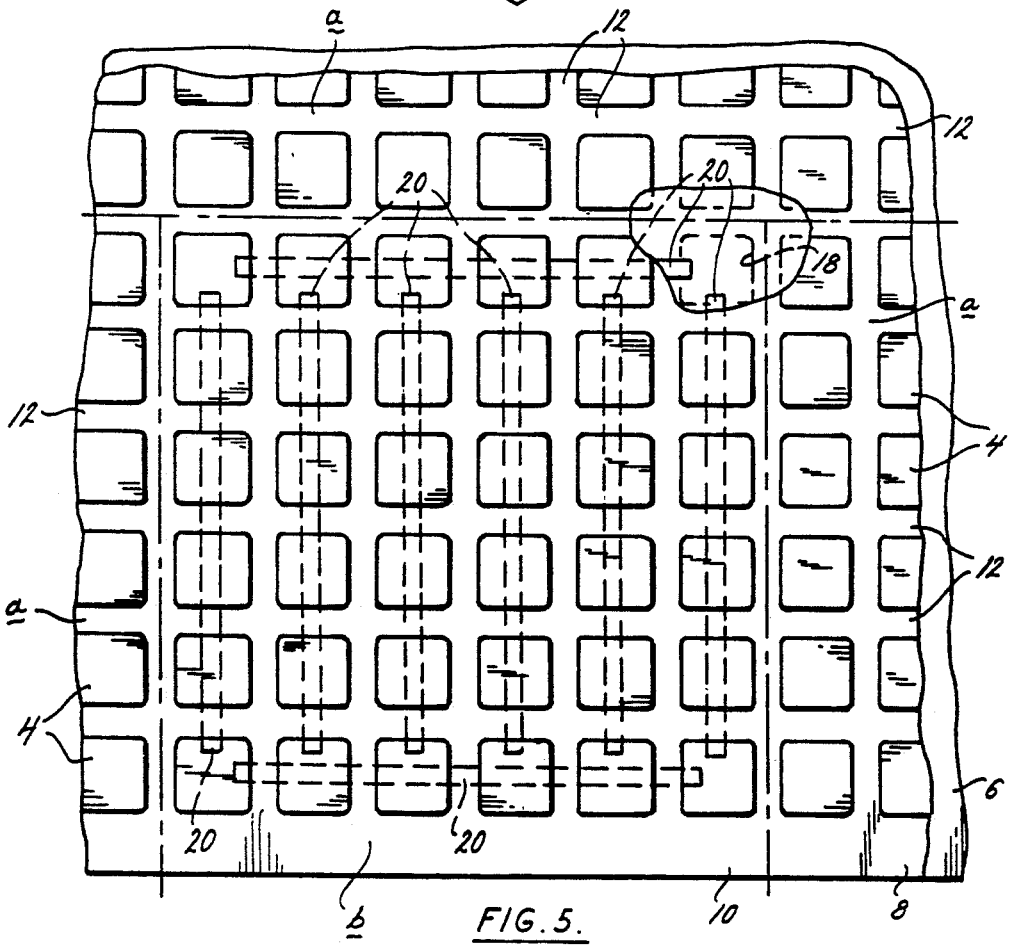
FIG. 5.

FIG. 6.
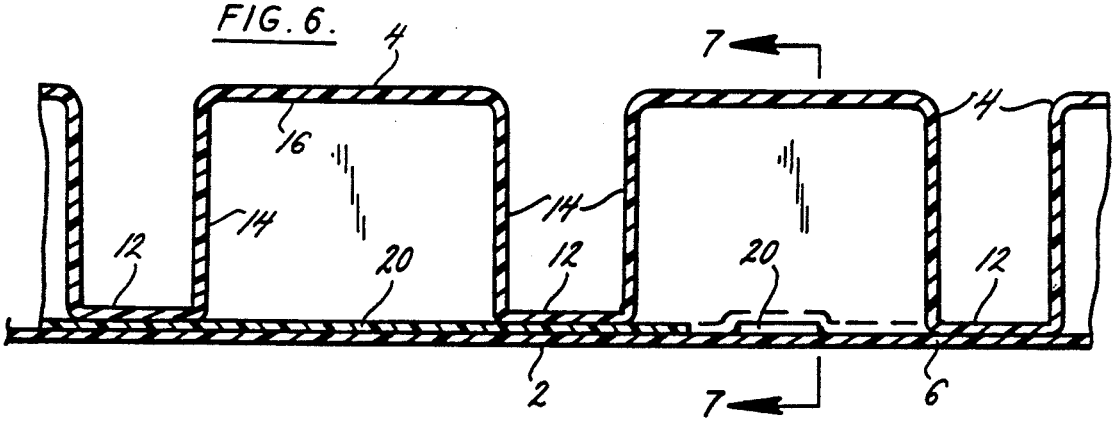
FIG. 7.
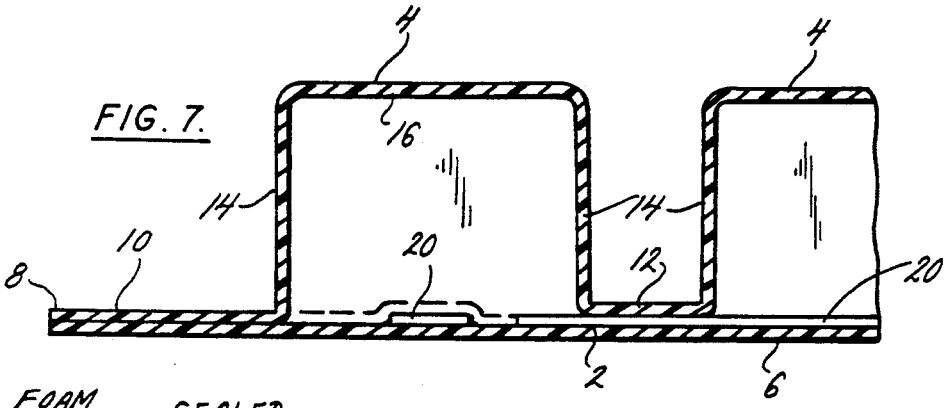
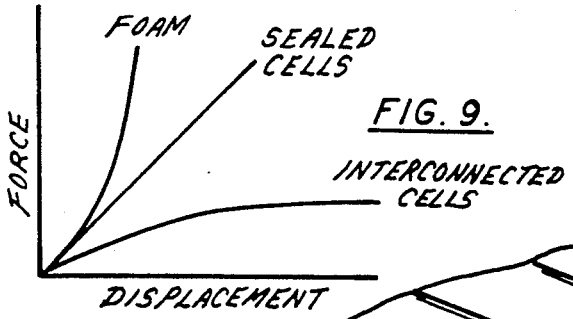
FIG. 9.
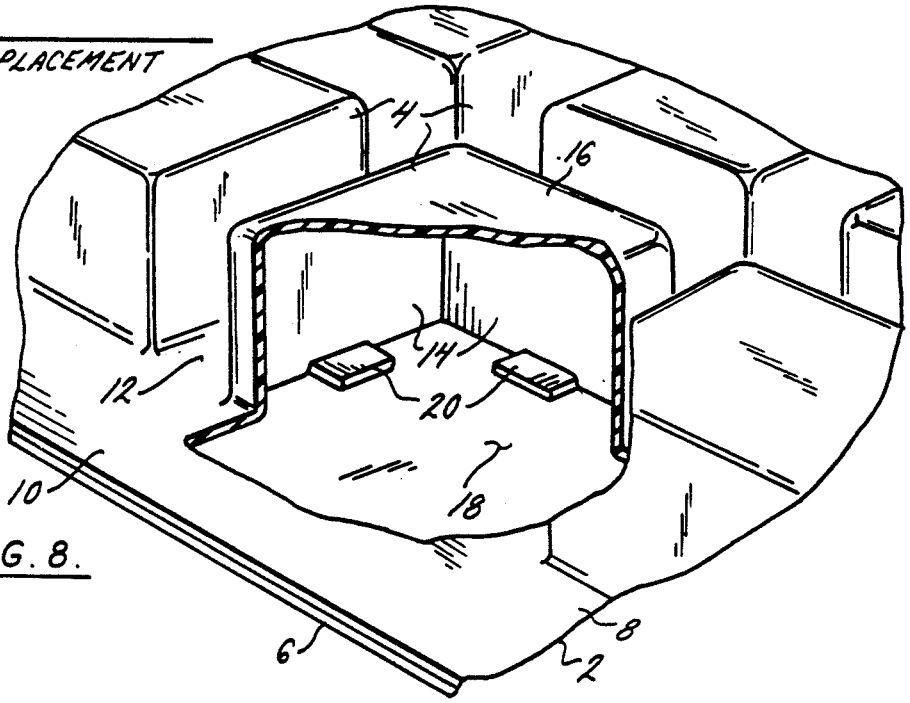
FIG. 8.

CELLULAR CUSHION HAVING SEALED CELLS

BACKGROUND OF THE INVENTION

This invention relates in general to cushions and, more particularly, to cellular cushions having sealed cells.

Cushions find a wide variety of applications, but perhaps one of the most important is in connection with seating. Most chairs have soft seat surfaces and many have padded back rests as well. In some, the padding even extends along the hips and thighs of the user. Expanded polymer foam of a resilient character, such as polyurethane, is a popular cushioning material for seating and indeed finds widespread use in furniture and automotive seats. But resilient polymer foam does not produce the most desirable relationship between force and displacement. Far from this relationship being linear, it tends to be skewed such that the force increases at a greater rate than the displacement, and this makes the material unusually stiff when an individual or object is deeply immersed in it.

For those who are confined to wheelchairs, seat cushions represent a matter of considerable importance, for such individuals, due to their lack of mobility, have a tendency to develop pressure sores, particularly in the region of the ischia, which is the bony prominences of the buttocks. Indeed, special cushions exist for these individuals. One of the most effective is a cellular cushion sold under the trademark ROHO. It utilizes closely spaced air cells which are interconnected through the base of the cushion. One who sits upon such a cellular cushion becomes immersed in the array of air cells, all of which possess the same internal pressure, and thus his weight is distributed generally uniformly over the supporting surface formed by the array. U.S. Pat. No. 4,541,136 to R. H. Graebe shows a ROHO cellular cushion.

But the cellular cushion is somewhat bulky and is not needed in more conventional seating applications. Moreover, it requires inflation and thereafter adjustment to obtain the correct immersion for the user. Furthermore, it is expensive—indeed, too expensive for more conventional seating applications. Finally, it is used primarily as a seat cushion or mattress where it supports most or all of the user's weight. It finds little use as padding for a back rest or along the side of the user.

The present invention resides in a cellular cushion having its cells formed from an elastomeric material, and at least some of the cells are totally sealed and isolated from one another. The cushion, owing to the gas contained in its cells and the elastomeric constituency of the cells, has a linear relationship between force and displacement and is suited for use as a seat cushion or in other applications where impact or shock protection padding is required.

DESCRIPTION OF THE DRAWINGS

In the accompanying drawings which form part of the specification and wherein like numerals and letters refer to like parts wherever they occur:

FIG. 1 is a perspective view of a cellular cushion constructed in accordance with and embodying the present invention;

FIG. 2 is a sectional view of the cushion taken along line 2—2 of FIG. 1;

FIG. 3 is a fragmentary perspective view of the cushion showing one of the cells partially broken away and in section;

FIG. 4 is a perspective view of a modified cellular cushion;

FIG. 5 is a fragmentary plan view showing the zone of interconnected cells in the modified cushion;

FIG. 6 is a sectional view taken along line 6—6 of FIG. 4;

FIG. 7 is a sectional view taken along line 7—7 of FIG. 6;

FIG. 8 is a fragmentary perspective view showing one of the cells of the modified cushion broken away in section, and;

FIG. 9 is a graphical representation showing the relationship between force and displacement for cushions having sealed cells, interconnected cells and for cushions formed from polymer foam.

DETAILED DESCRIPTION

Referring now to the drawings, a cushion A (FIG. 1), which is suited for a wide variety of applications where padding is required or desired, basically includes a base 2 and cells 4 which project from the base 2, forming an array of closely spaced cells 4 on the base 2. Preferably the base 2 is rectangular, and the cells 4 are organized in longitudinal and transverse rows on it. The spacing between the cells 4 is relatively small, so that the outer ends of the cells 4 provide a surface against which the individual or object requiring padding bears. Yet the cells 4 are not so close together that they interfere with each other, so they deflect freely and independently of each other. Both the base 2 and cells 4 are formed from a flexible and indeed elastomeric—material such as synthetic rubber, preferably the synthetic rubber known as neoprene.

The base 2 consists of two layers 6 and 8 (FIGS. 2 & 3) which are bonded tightly to each other so as to appear as one. The lower or back layer 6 is continuous throughout and is derived from a neoprene sheet. The upper or front layer 8, on the other hand, is formed integral with the cells 4 which project outwardly from it. To this end, the layer 8 includes a peripheral section 10 which extends around the array of cells 4 and possesses the four margins that form the periphery of the base 2 and a series of interconnected webs 12 which lie between and separate the cells 4. The webs 12 extend between the rows of cells 4 and at their ends merge into the peripheral section 10. The layer 8 is bonded to the layer 6 without interruption along all of the webs 12 and likewise along the entirety of the peripheral section 10. This has the effect of isolating the interiors of the cells 4 from each other and from the surrounding atmosphere as well. Rubber cement serves as an excellent bonding agent where the layers 6 and 8 are neoprene.

Each air cell 4 has four side walls 14 (FIG. 3) that extend away from the base 2 and an end wall 16 that is attached to the side walls 14 beyond the base 2 to close the outer end of the cell 4. More specifically, four side walls 14 are formed integral with the upper layer 8 of the base 2 along four different webs 12 and of course are attached to the layer 8 at those webs 12. The four side walls 14 are also joined integrally to each other at the corners of the cell 4. The end wall 16 is attached to the remaining margins of each side wall 14. Being located in two rows, any cell 4 has two of its side walls 14 coplanar with corresponding side walls 14 of the other cells 4 in one of the rows, and its remaining two side walls 14 coplanar with the corresponding side walls 14 in the crossing row, assuming, of course, that the cells 4 are undistorted. The cells 4 where they rise from the upper layer 8 of the base 2 leave the upper layer 8 with square openings 18 which are likewise organized into longitudinal and transverse rows, but the openings 18 are normally not visible for they are closed and obscured by the lower layer 6 of the base 2. The interiors of the cells 4 open through the openings 18 toward the continuous layer 6.

The upper layer 8 of the base 2 and the cells 4 which project from it are simultaneously formed in a dipping operation, an operation in which a mold having cubic protrusions extended from a flat surface is dipped into liquid neoprene. U.S. Pat. No. 3,870,450 discusses the procedure in the context of differently shaped protrusions. Once the dipped part has cured, its exterior surface is subjected to an oxidizing agent, such as a chlorine or bromine solution, and that reduces the coefficient of friction for the rubber and actually makes its surface slick. This prevents adjacent cells 4 from clinging to each other upon contact.

Each cell 4 contains an entrapped gas which is normally air. After all, the side walls 14 and 16 are united into a single impervious molding that encloses a hollow interior having but a single opening, the square opening 18. But the opening 18 is closed by the impervious bottom layer 6 of the base 2 which is sealed to the top layer 6 completely around the opening 18. In this regard, it will be recalled that the webs 12 and the peripheral section 10 of the upper layer 8 are attached without interruption to the lower layer 6.

When one sits upon the cushion A or otherwise exerts a force on it, the cells 4 deflect, and the deflection to a measure follows the contour of the person which exerts the force. Impacts are absorbed in a like manner. The deflection finds accommodation not only in the compressibility of the gas which is entrapped in the cells 4, but also in the expansibility of walls 14 and 16 of the cells 4, that expansibility, of course, being derived from the elastomeric properties of the neoprene.

In any event, the entrapped gas and elastomeric character of the cells 4 provides the cushion A with generally linear deflection characteristics. In other words, the displacement of any section of the cushion, generally speaking, is directly proportional to the force causing that deflection. This may be represented graphically as a plot of force against displacement on Cartesian coordinates (FIG. 9). The plot is essentially a straight line. On the other hand, a foam cushion tends to stiffen as it is deflected, requiring greater and greater force to achieve a unit increment of displacement as the displacement increases. The cellular cushion with its interconnected cells, on the other hand, shows generally constant force characteristics after an initial deflection, and as such demands essentially the same force irrespective of the deflection.

Since the cells 4 are organized into rows that extend both transversely and longitudinally, and the cells 4 of any row are separated by a web 12 that is continuous and straight, the cushion A may be trimmed to a smaller size simply by cutting it through one of its webs 12. Anyone of the straight webs 12 also provides a convenient line along which one may fold the cushion A, and this facilitates transformation into a smaller and more compact configuration. By the same token, the straight webs 12 permit the cushion A to be easily rolled into a compact bundle.

The cushion A is well suited for use on a seating surface, such as a chair seat or automobile seat. It may also be used over a back rest. For those confined to wheelchairs, the cushion A provides excellent padding along the sides of the user's hips and thighs to protect the user from the hard steel members of the wheelchair frame. This feature also enables the cushion A to conform without any distortion of its cells 4 to contoured surfaces, such as the sling-type seat of a wheelchair or the classic sculpted seating surface with its abductor and depression. The cushion A may also find use as padding for fragile goods in transit or in storage.

A modified cushion B (FIGS. 4–8), which is ideally suited for use over a seating surface S, resembles the cushion A in outward appearance. As such it has a rectangular base 2 from which cells 4 project, with the cells 4 being arranged in longitudinal and transverse rows separated by webs 12. The array of cells 4 is moreover surrounded by a peripheral section 10 that forms part of the base 2. Unlike the cushion A, not all of the cells 4 are totally isolated from each other.

To be sure, the cushion B has sealed or isolated cells 4, and these cells 4 are arranged in a zone a of generally U-shaped configuration. More specifically, the zone a occupies several longitudinal rows at each side of the base 2 and a greater number of transverse rows at the front of the base 2. The remaining cells 4 lie in a zone b which is centered between the two side margins of the base 2 and extends out to and includes a portion of the last transverse row along the rear margin of the base 2. Whereas the cells 4 of the zone a are sealed and totally isolated from each other, the cells 4 of the zone b are interconnected, that is to say their interiors are in communication with each other. Thus, the sealed cells 4 of the zone a exhibit a generally linear relationship between force and displacement, while the interconnected cells of the zone b display generally constant relationship (FIG. 9).

To achieve communication between the cells 4 within the zone b, the bonds between the webs 12 of the top layer 8 and the continuous bottom layer 6 are interrupted with separating strips 20 that extend along each of the longitudinal rows within the zone b as well as along the forwardmost and rearmost transverse rows in that zone. Each strip 20, while being flexible like the base 2, is considerably narrower than the cells 4 and the square openings 18 that the cells 4 create in the upper layer 8. Whereas the two layers 6 and 8 are bonded tightly to each other with rubber cement along the webs 12 of the latter, the strips 20 are not. To this end, they may be formed from a polymer to which the rubber cement does not bond, or if they are formed from neoprene, no rubber cement is applied to the strips 20, and better still the strips 20 are coated with powdered talc or some other substance to ensure that the cement does not adhere to them. In any event, the strips 20 establish slight separations or channels in the webs 12 between adjacent cells 4 within the zone b, so that all of the cells 4 within the zone b communicate and exist at the same internal pressure.

Being located midway between the side margins of the base 2 in generally the rear half of the cushion A, the zone b is located beneath the ischia or bony prominences of the buttocks for one who sits upon the cushion B. The skin in this region of the buttocks has little natural padding from muscle and fat and is therefore the more likely to develop pressure sores in the absence of adequate blood circulation. Whereas the sealed cells 4 of the zone a will remain relatively firm and support the individual at the large muscles of the thighs and buttocks, the interconnected cells 4 of the zone b will yield and conform more easily to the contours of the bony prominences. Each cell 4 within the zone b will exist at the same internal pressure irrespective of the magnitude of its deflection, so those cells 4 that are directly beneath the bony prominences will not exert any greater supporting force than those interconnected cells 4 that are offset from the bony prominences.

While the cells 4 are generally square or of rectangular cross-section, they may assume other cross-sectional configurations as well. For example, a hexagonal cross-section enables a greater density of cells within an array, provided that the cells of adjacent rows are staggered. But this makes the cushion more difficult to fold or roll and to likewise cut into segments. Cells of circular cross-section are also possible.

This invention is intended to cover all changes and modifications of the example of the invention herein chosen for purposes of the disclosure which do not constitute departures from the spirit and scope of the invention.

What is claimed is:

1. A cushion comprising: a flexible base and a plurality of flexible cells arranged in an array on and projecting from the base to provide a surface against which a person or object that is to be cushioned is placed; the cells being arranged in aligned longitudinal and transverse rows with each cell in a row being immediately adjacent to the next cell in said row and a web separating the rows such that the cell walls of adjacent cells are independent and spaced from each other when inflated; each cell containing a gas and being formed from an elastomeric material, at least some of the cells being sealed in the sense that the interiors of such cells are isolated from the interiors of the other cells and from the surrounding atmosphere so that the gas contained within such cells is entrapped in those cells, the trapped gas and the elasticity of the elastomeric material for the sealed cells providing the sealed cells with generally linear deflection characteristics.

2. A cushion according to claim 1 wherein each cell has side walls connected to the base and an end wall connected to the side walls remote from the base; and wherein the end wall of each cell when the cell is undistorted, is flat and lies generally parallel to the base.

3. A cushion according to claim 1 wherein all of the cells are sealed cells whereby the interiors of the cells are totally isolated from the interiors of the other cells and from the atmosphere.

4. A cushion comprising: a rectangular base formed from first and second flexible layers, the first layer having apertures located within it in an array as well as webs located between adjacent apertures of the array and a peripheral section surrounding the array of apertures, the second layer being continuous and attached to the first layer at the webs and at the peripheral section; and flexible cells attached to the first layer of the base around the apertures of that layer and projecting from the base so that the interiors of the cells open toward the second layer of the base at the apertures in the first layer, the cells being arranged in aligned longitudinal and transverse rows with each cell in a row being immediately adjacent to the next cell in said row and a web separating the rows such that the cell walls of adjacent cells are independent and spaced from each other when inflated; each cell containing a gas and being formed from an elastomeric material, at least some of the cells being sealed in the sense that the interiors of such cells are totally isolated from the interiors of the other cells and from the surrounding atmosphere, the trapped gas and the elasticity of the elastomeric material for the sealed cells providing the sealed cells, when deflected from the ends at the cells remote from the base, with substantially linear deflection characteristics.

5. The cushion of claim 4 wherein all of the cells are sealed whereby the interiors of the cells are totally isolated from the interiors of the other cells and the atmosphere.

6. A cushion comprising: a flexible base and a plurality of flexible cells arranged in an array of longitudinal and transverse rows on the base and projecting from the base to provide a surface against which a person or object that is to be cushioned is placed; the base having webs that separate adjacent cells and a substantially continuous layer that is attached to the webs and closes the bottoms of the flexible cells, the webs being of uniform width and separating the rows of cells, each cell containing a gas and being formed from an elastomeric material, some of the cells being sealed in the sense that the interiors of such cells are isolated from the interiors of the other cells and from the surrounding atmosphere so that the gas contained within such cells is entrapped in those cells, others of the cells being connected such that their interiors are in communication, so that the gas within all of the interconnected cells remains at the same pressure irrespective of the deflection encountered by any of such interconnected cells.

7. A cushion comprising: a flexible base and a plurality of flexible cells arranged in an array of longitudinal and transverse rows on the base and projecting from the base to provide a surface against which a person or object that is to be cushioned is placed; the base having webs that separate adjacent cells and a substantially continuous layer that is attached to the webs and closes the bottoms of the flexible cells, the webs being of uniform width and separating the rows of cells, each cell containing a gas and being formed from an elastomeric material, at least some of the cells being sealed in the sense that the interiors of such cells are isolated from the interiors of the other cells and from the surrounding atmosphere so that the gas contained within such cells is entrapped in those cells, the cells being organized into first and second zones, with the cells of the first zone being sealed and the cells of the second zone being interconnected such that they are in communication through the base.

8. A cushion according to claim 7 wherein the first zone extends along the sides and front of the second zone.

9. A cushion comprising: a rectangular base formed from first and second flexible layers, the first layer being formed from and elastomeric material and having rectangular apertures located within it in an array where they are organized into longitudinal and transverse rows, the first layer also having webs located between adjacent apertures of the array so as to extend between the rows and a peripheral section surrounding the array of apertures, the second layer being continuous and attached to the first layer at the webs and at the peripheral section; and flexible cells attached to and formed integral with the first layer of the base around the apertures of that layer and projecting from the base so that the interiors of the cells open toward the second layer of the base at the apertures in the first layer, each cell containing a gas and being formed from an elastomeric material, at least some of the cells being sealed in the sense that the interiors of such cells are totally isolated from the interiors of the other cells and from the surrounding atmosphere, the cells being arranged in first and second zones, with the cells of the first zone being sealed and thereby having their interiors isolated and the cells of the second zone being interconnected in that they have their interiors in communication through the base.

10. A cushion according to claim 9 wherein the base is rectangular and the cells of the first zone lie on two sides and in front of the cells of the second zone.

* * * * *